US005911186A

United States Patent [19]

Kinoshita et al.

[11] Patent Number: 5,911,186

[45] Date of Patent: Jun. 15, 1999

[54] UNDER THREAD DETECTION DEVICE FOR SEWING MACHINE

[75] Inventors: Haruhiko Kinoshita, Nagoya; Yoshito Hasegawa, Aichi-ken, both of Japan

[73] Assignee: Kinoshita Precision Industrial Co. Ltd., Nagoya, Japan

[21] Appl. No.: 08/931,620

[22] Filed: Sep. 16, 1997

[51] Int. Cl.[6] ..... D05B 45/00

[52] U.S. Cl. ..... 112/278

[58] Field of Search ..... 112/278, 273; 242/37 R, 37 A, 38, 563, 563.2

[56] References Cited

U.S. PATENT DOCUMENTS 5,322,029 6/1994 Fujita ..... 112/278

5,339,758 8/1994 Fujita ..... 112/278

*Primary Examiner*—Peter Nerbun

*Attorney, Agent, or Firm*—Sughrue, Mion, Zinn, Macpeak & Seas, PLLC

[57] ABSTRACT

In an under thread detection device for a sewing machine, a probe arm is located outside a rotary bobbin case, and is adapted to be accessible to a bobbin through a space provided at the rotary bobbin case when the rotary bobbin case ceases its rotary movement. An urging member provides an urging force in such a direction as to urge the probe arm toward a stem of the bobbin. A wire transmits the urging force of the urging member to the probe arm. A stroke detection device measures a stroke displacement of the wire. A detection control device calculates a residual amount of an under thread wound on the bobbin on the basis the stroke displacement measured by the stroke detection device. A display device exhibits the residual amount of the under thread wound on the bobbin on the basis of the calculation performed by the detection control device.

13 Claims, 6 Drawing Sheets

UNDER THREAD DETECTION DEVICE FOR SEWING MACHINE

BACKGROUND OF THE INVENTION

1. Field of the Invention

This invention relates to an under thread detection device for a sewing machine which is capable of detecting a residual amount of an under thread wound on a bobbin without taking the bobbin out of a bobbin housing.

2. Description of the Prior Art

Upon sewing apparel cloths with the use of a sewing machine, there is the possibility that a sewing operator may unwittingly exhaust the under thread from a bobbin while doing the sewing operation. Once the under thread is exhausted from the bobbin while doing the sewing operation, it leads to deterioration in the commercial value of the clothes. In order to avoid the deterioration of commercial value, it is necessary to undo the sewn portion of the apparel cloths and, depending the clothes (e.g., suit) to be sewn again sew the clothes correctly.

There are various ways to recognize the residual amount of the under thread. One is to presuppose it, from the sewing amount required to finish the apparel, when exchanging bobbins. Another way is to visually recognize the residual amount of the under thread by taking out the bobbin before restarting the sewing operation.

However, the former has a drawback in that the under thread may be unwittingly exhausted while doing the sewing operation, particularly when an amount of the under thread wound on the bobbin is small. The latter also has a disadvantage in that sewing workability is reduced because it is necessary to take the bobbin out of the bobbin housing each time the sewing operation is started.

With the above situation as a backgound, although it has been demanded that an under thread detection device be introduced in the market place, it is very difficult to install the under thread detection device on a limited space around a rotary bobbin frame to which the bobbin is placed.

Even if the the under thread detection device can be installed around the rotary bobbin frame of a specified type sewing machine, it can not always be installed on other types of sewing machines because a space around a rotary bobbin frame is different depending on the type of a sewing machine. Thus it is difficult to mass produce the under thread detection device, rendering the device costly.

Even when installing the device on the limited space around the rotary bobbin frame, the device is likely to undergo malfunction because the device is in such an adverse environment as to subject it to a great amount of wasted thread and lubricating oil jumping across the space in combination with the rotary movement of the bobbin frame.

Therefore, it is a main object of the invention to provide an under thread detection device suited for a general purpose application which is capable of recognizing a residual amount of an under thread without taking the bobbin outside the bobbin frame while eliminating the malfunction due to the wasted thread and lubricating oil.

SUMMARY OF THE INVENTION

According to the present invention, upon actuation of the urging member while suspending the sewing operation, the urging force of the urging member is transmitted to a probe arm by way of a wire member so as to guide the probe arm toward the stem of the bobbin. The stroke displacement of the wire member changes depending on the thickness of the under thread wound on the bobbin.

That is to say, when the stroke displacement of the wire member is great, the residual amount of the under thread is small because of the reduced thickness of the under thread.

On the other hand, when the stroke displacement of the wire member is small, the residual amount of the under thread is great because of the increased thickness of the under thread.

The stroke displacement of the wire member is measured by the stroke detection member, and the residual amount of the under thread is calculated by a detection control member on the basis of the stroke displacement measured by the stroke detection member. Then, the residual amount of the under thread is exhibited by a display device.

Because the residual amount of the under thread is displayed on the basis of the stroke displacement of the wire member, it is possible to recognize the residual amount of the under thread without taking out the bobbin before starting the sewing operation. This obviates the problem of the under thread being exhausted while continuing the sewing operation.

Because the probe arm is connected to the urging member so as to advance into the bobbin frame by way of the wire member, it is possible to install the urging member at a position other than the limited space around the bobbin frame. Because it is possible to install the urging member at redundant space of the sewing machine, it is possible to install it on various types of sewing machines as a general purpose application which enables mass production with the least cost.

Because the urging member is installed at a position other than the limited space around the bobbin frame, it is unlikely that the urging member is exposed to the waste thread and lubricating oil thereby preventing malfunction of the urging member. This makes it possible to attain an extended period of service life without malfunction.

According to another aspect of the present invention, the detection control member actuates the urging member so as to detect the residual amount of the under thread wound on the bobbin on the basis of the stroke displacement in association with the the sewing needle reaching the top dead center at the time of suspension of the sewing operation when the sewing operation has ended or the sewing thread has accidentally been severed.

Since the residual amount of the under thread is detected each time the sewing needle reaches the top dead center during suspension of the sewing operation, the residual amount of the under thread is automatically displayed so as to make the under thread detection device convenient to use.

According to another aspect of the present invention, a movable portion of the urging member moves in unison with the wire member when the urging member urges the wire member. This makes it possible to measure the stroke displacement of the wire member by measuring that of the movable portion of the urging member.

According to another aspect of the present invention, a rack slides in association with the movement of a movable portion of the urging member. The sliding rack rotates a pinion in unison with a notched disc. A photosensor counts the number of slits on the notched disk which pass therethrough. Thus, the stroke displacement that the movable portion of the urging member generates is converted into the passage of a number of the slits, thereby making it possible to measure the stroke displacement of the wire member based on the number of the slits which pass the photosensor.

Since the notched disc is diametrically greater than the pinion, it is possible to increase the number of the slits so as to measure the stroke displacement with a high accuracy.

According to another aspect of the present invention, by using a helical coil spring having no space between the neighboring coils, it is possible to precisely transmit the stroke displacement to the probe arm with no substantial variation. This makes it possible to accurately measure the wound thickness of the under thread from the stroke displacement of the wire member.

BRIEF DESCRIPTION OF THE DRAWINGS

The preferred embodiments of the invention will be described in more detail with reference to the following drawing figures, in which.

DETAILED DESCRIPTION OF PREFERRED EMBODIMENTS OF THE INVENTION

Figure 1:
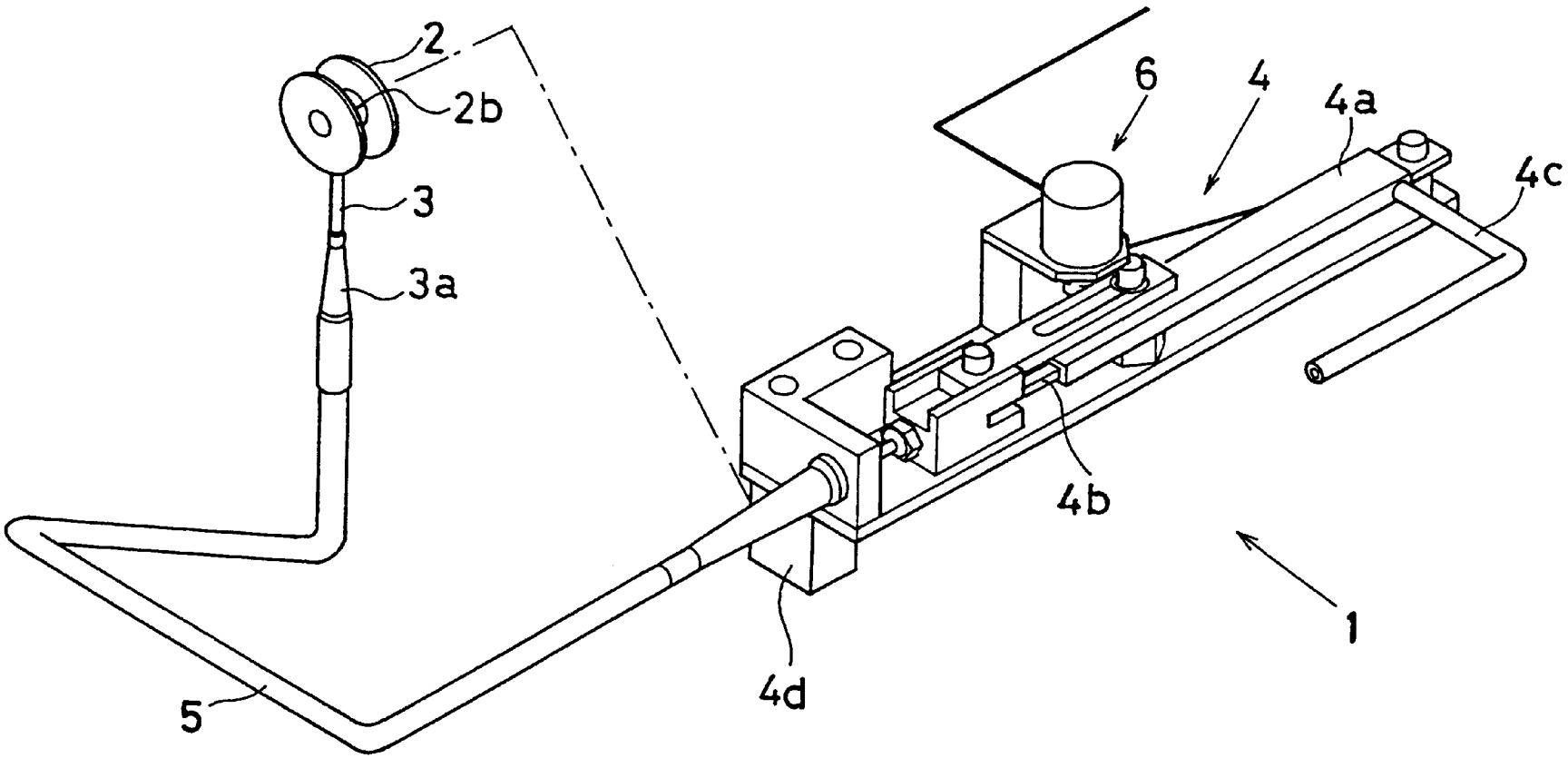
FIG. 1 is a schematic view of an under thread detection device for a sewing machine according to a first embodiment of the invention.

FIG. 1 shows an under thread detection device 1 according to a first embodiment of the invention. The device 1 has a probe arm 3 adapted to be accessible toward a stem 2*a* of a bobbin 2 which is encased into a rotary bobbin frame (not shown) of a sewing machine. An urging member 4 is provided to generate an urging force which is transmitted to the probe arm 3 via a wire member 5. A stroke displacement detection member 6 is provided to measure a stroke displacement of the wire member 5. A detection control member 7 (FIG. 5) is provided to calculate a residual amount of the under thread on the basis of the stroke displacement measured by the stroke displacement detection member 6. A display device 8 (FIG. 5) is provided to exhibit the residual amount of the under thread.

The probe arm 3 is usually situated under the rotary bobbin frame (not shown) while the sewing machine is in use. While the sewing operation is suspended thereby ceasing the rotary movement of the bobbin frame, the probe arm 3 is extended inside of the bobbin frame through a space provided on an underside of the bobbin frame so as to access toward the stem 2*a* of the bobbin 2. The probe arm 3 is adapted to vertically slide in a reciprocal direction within a guide cylinder 3*a* which is fixed to the sewing machine via a stay (not shown).

The urging member 4 is installed at a redundant space within the sewing machine other than the limited space around the bobbin frame. The urging member 4 generates a pneumatic pressure as an urging force which exerts the probe arm 3 toward the stem 2*a* of the bobbin 2 by way of a wire member 5.

The urging member 4 has a cylinder 4*a* to which the pneumatic pressure is supplied. The urging member 4 further has a piston (movable portion) 4*b* which moves when the pneumatic pressure is supplied to the cylinder 4*a* so as to urge the wire member 5. The piston 4*b* is moved back toward the original position by means of a spring member (not shown) which is always urging the piston 4*b* backward. An electromagnetic valve (not shown) is on-off actuated to open and close an inlet of a pneumatic supply hose 4*c* through which the pneumatic pressure is supplied to the cylinder 4*a*.

Figure 2:
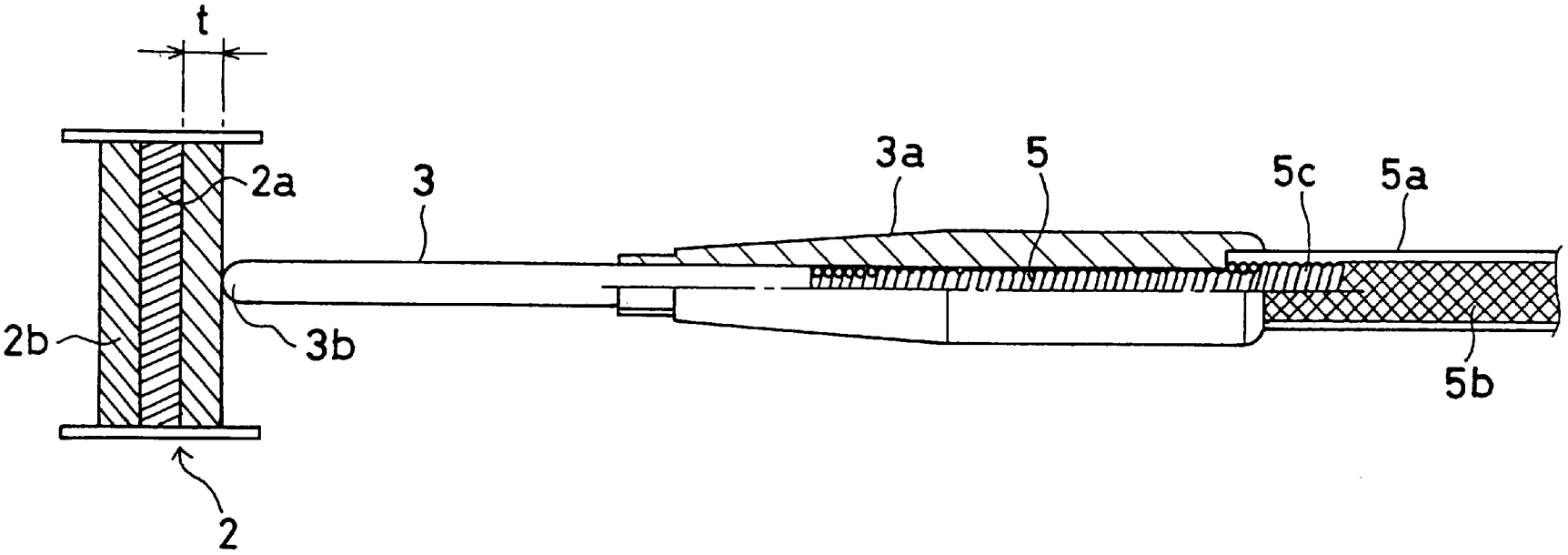
FIG. 2 is a partial cross sectional view of a probe arm and a wire member according to the first embodiment of the invention.

As shown in FIG. 2, a helical coil spring serves as the wire member 5 in which a wire is helically coiled with no space between the neighboring coil segments. That means that a pitch of the helical coil spring is zero. By way of the wire member 5, the urging force that the urging member 4 generates is transmitted to the probe arm 3. For this purpose, the wire member 5 is adapted to be reciprocally movable within an elastic guide 5*c* which is coated by a metallic mesh 5*b* and a vinyl tube 5*a*.

Figure 3:
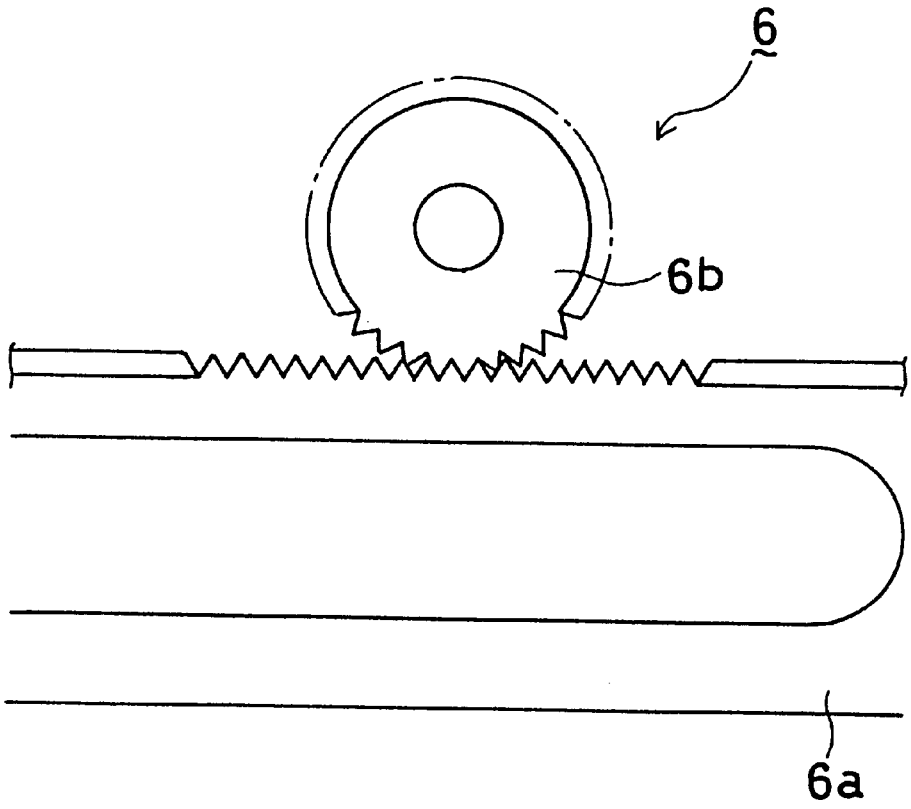
FIG. 3 is a schematic view of a stroke displacement detection member according to the first embodiment of the invention.
Figure 4:
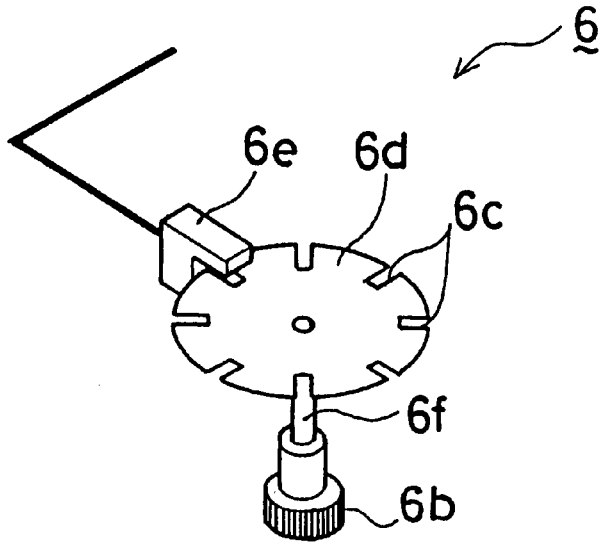
FIG. 4 is a perspective view of a stroke displacement detection member according to the first embodiment of the invention.

A stroke displacement detection member 6 measures a stroke displacement of the piston (movable portion) 4*b* of the urging member 4. As shown in FIGS. 3 and 4, the stroke displacement detection member 6 has a rack 6*a* adapted to slide in unison with the piston 4*b*, and has a pinion 6*b* adapted to rotate in association with the sliding movement of the rack 6*a*. To a rotary axis 6*f* of the pinion 6*b*, a notched disc 6*d* is connected to rotate in unison with the pinion 6*b*. The notched disc 6*d* has radial slits 6*c* at regular intervals (e.g., 45 degrees) in the circumferential direction. The notched disc 6*d* is diametrically greater than the pinion 6*b* so as to impart a room for having an increased number of the radial slits. In the manner to sandwich a periphery of the notched disc 6*d*, a fork-shaped photosensor 6*e* is provided to detect the number of the radial slits 6*c* passing through the photosensor 6*e* in association with the rotational movement of the notched disc 6*d*.

By way of illustration, the radial slits 6*c* are prepared such that a single radial slit 6*c* passes the photosensor 6*e* each time when the piston 4*b* moves by 0.1 mm so as to detect a displacement of the probe arm 3 with a high accuracy.

Figure 5:
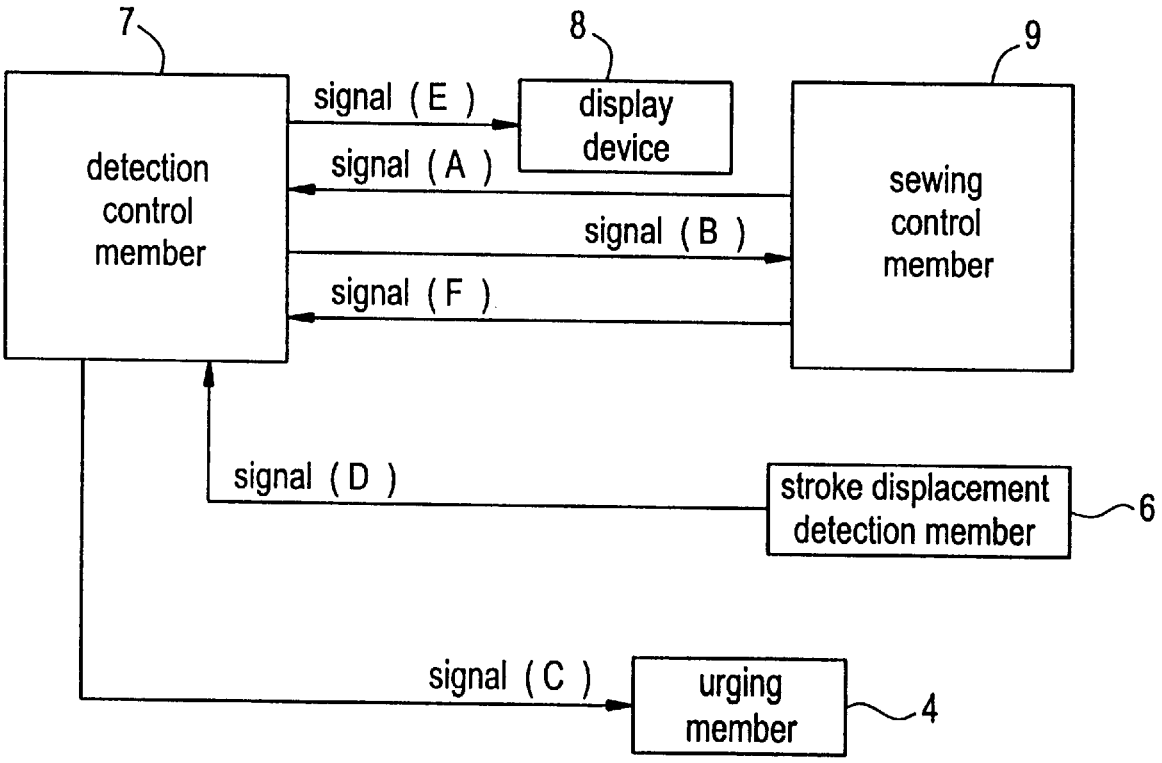
FIG. 5 is a block diagram of a detection control member according to the first embodiment of the invention.

A detection control member 7 includes an integrated circuit (CPU, ROM, RAM) having an urging member control function in which an electrical signal from a sewing control circuit 9 is received in order to control the urging member 4 as shown in FIG. 5. The detection control member 7 further has a residual amount calculation function which calculates a residual amount of the under thread on the basis of the stroke displacement measured by the stroke displacement detection member 6, and has a residual amount detection function which calculates the residual amount of the under thread while continuing the sewing operation by a residual amount of the under thread used during the sewing operation from the residual amount of the under thread detected by the residual amount calculation function. The detection control member 7 has a display function to finally exhibit the calculated residual amount of the under thread on a display device 8.

Namely, when the detection control member 7 receives the electrical signal (A) that the sewing operation has ended and the sewing needle has reached the top dead center, the control member 7 generates an electrical signal (B) to order the sewing control circuit 9 to cease the sewing operation. Then, the detection control member 7 generates an electrical signal (C) to actuate the urging member 4 to urge the wire member 4 so as to advance the probe arm 3 into the bobbin frame through the space which is provided on the underside of the bobbin frame. The probe arm 3 advances until it touches on the under thread 2*b* wound the stem 2*a* of the bobbin 2, as shown in FIG. 2. With the actuation of the urging member 4, the sliding rack 6*a* rotates the notched disc 6*d* in unison with the pinion 6*b*. The photosensor 6*e* generates a passage signal (D) each time a radial slit passes through the photosensor 6*e*. The number of the passage signals (D) is counted by the detection control member 7. On the basis of the number of passage signals (D) i.e., the stroke displacement of the wire member 5, the detection control member 7 calculates the residual amount of the under thread 2*b* wound on the bobbin 2.

The residual amount of the under thread 2*b* is obtained from a residual map, prepared in advance, which relates various numbers of passage signals (D) with various residual amounts of the under thread 2*b*. Alternatively, the thickness (t) of the residual amount of the under thread 2*b* can be obtained by detecting the difference between the original thickness of the under thread and the stroke displacement of the wire member 5 (i.e., the number of the passage signals (D)).

The detection control member 7 generates an electrical signal (E) which corresponds to the residual amount of the under thread 2*b* so as to feed the electrical signal (E) to the display device 8 so as to visually exibit the residual amount of the under thread 2*b*. Note that the detection control member 7 terminates the electrical signal (C) to deactuate the urging member 4 when a leading end 3*b* of the probe arm 3 touches the under thread wound on the bobbin 2. After the probe arm 3 retracts outside the bobbin frame by terminating the electrical signal (C), the detection control member 7 terminates the electrical signal (B) ordering the sewing control member 9 to stop the sewing machine so as to be ready to restart the sewing operation.

In the detection control member 7, the residual amount of the under thread 2*b* is temporarily stored into RAM when the leading end 3*b* of the probe arm 3 touches the under thread wound on the bobbin 2. The residual amount of the under thread 2*b* stored into RAM is usually on the display device 8. When RAM is omitted, the residual amount of the under thread 2*b* may be displayed only when the residual amount of the under thread 2*b* is detected.

Beneath the under thread detection device 1, an under thread detection member 4*d* is provided to detect a reduced amount of the under thread wound on the bobbin in accordance with the passage of the sewing operation. The under thread detection member 4*d* receives a stitching number signal (F), which is indicative of the stitching action of the sewing needle and is generated from the sewing control member 9, so that the detection control member 7 detects the amount of under thread used during a continuous sewing operation.

To the detection control member 7, the sewing control member 9 feeds the stitching number signal (F) so as to deduct the corresponding stitch number signal (F) from the residual under thread stored by RAM so as to continuously display the residual amount of the under thread 2*b*.

Note that a feeding length of the apparel cloths may be converted into a feeding signal so as to successively deduct the corresponding feeding signal from the residual under thread stored by RAM.

The display device 8 vidually exibits the residual amount of the under thread 2*b* in the form of numerical value or dot number by using a liquid crystal panel or light emitting diode. In addition to the visually exibiting function, the display device 8 may have a warning function such as a buzzer, chime or vocal alarm when the residual amount of the under thread 2*b* is reduced to a predetermined level.

With the structure thus far described, upon restarting the sewing operation after ending the preceding sewing works, the sewing thread is severed from the apparel cloths with the sewing needle at the top dead center.

When the sewing needle reaches the top dead center, the sewing operation is automatically prohibited so that the under thread detection device 1 is ready to activate.

When the under thread detection device 1 is activated, the urging member 4 is actuated to transmit the urging force to the probe arm 3 by way of the wire member 5. Then, the probe arm 3 extends to advance its leading end 3*b* into the bobbin frame via the space provided on the underside of the bobbin frame until the probe arm 3 touches its leading end 3*b* on the under thread 2*b* wound on the bobbin 2.

In association with the sliding movement of the wire member 5, the notched disc 6*d* rotates in unison with the pinion 6*b* so that the photosensor 6*e* counts the number of the radial slits 6*c* which pass thereby. On the basis of the number of the radial slits 6*c*, which pass detection control member 7 calculates the residual amount of the under thread 2*b* wound on the bobbin 2 so as to exhibit it on the display device 8.

After detecting the residual amount of the under thread 2*b*, the urging member 4 is deactuated to return to the original position outside the bobbin frame so as to be ready to resume the sewing operation. Upon resuming the sewing operation. The detection control member 7 successively deducts from the residual amount of the under thread 2*b* in accordance with the stitch number of the apparel cloths. The residual amount of the under thread 2*b* thus deducted is renewed by RAM so as to continuously exhibit it on the display device 8.

Figure 6:
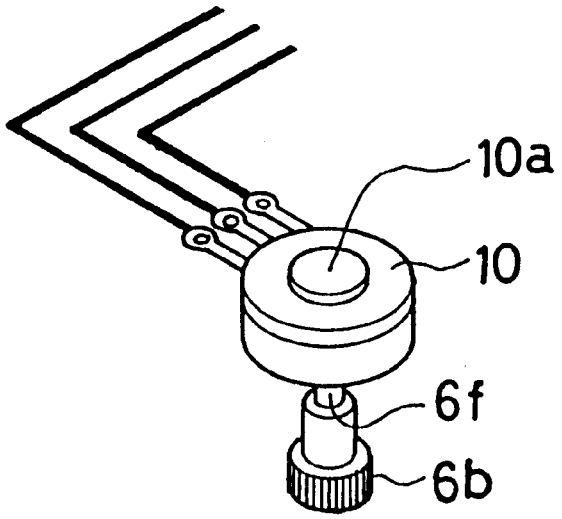
FIG. 6 is a perspective view of a main portion of a stroke displacement detection member according to a second embodiment of the invention.

FIG. 6 shows a second embodiment of the invention in which the rotary axis 6*f* of the pinion 6*b* is connected to a knob 10*a* of a variable resistor 10. From the change of the electrical resistance value of the variable resistor 10, it is possible to calculate the rotational movement of the pinion 6*b* i.e., the stroke displacement of the wire member 5.

Figure 7:
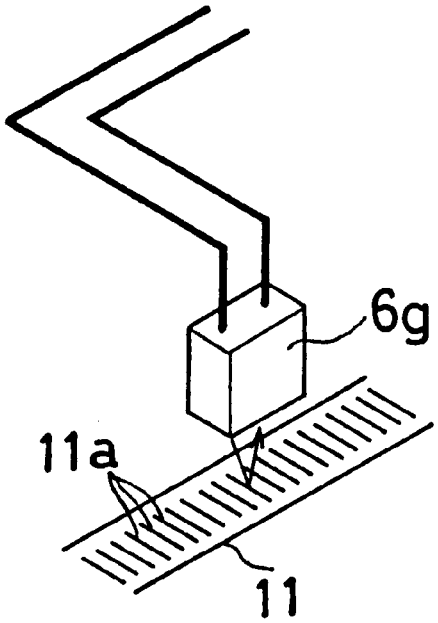
FIG. 7 is a perspective view of a main portion of a stroke displacement detection member according to a third embodiment of the invention.

FIG. 7 shows a third embodiment of the invention in which a ribbon tape 11 is provided to move in unison with the wire member 5. On the ribbon tape 11, a multitude of striae 11*a* is depicted at regular intervals in a direction to traverse the ribbon tape 11. A photosensor 6*g* counts the number of the striae 11*a* passing therethrough so as to calculate the stroke displacement of the wire member 5.

Figure 8:
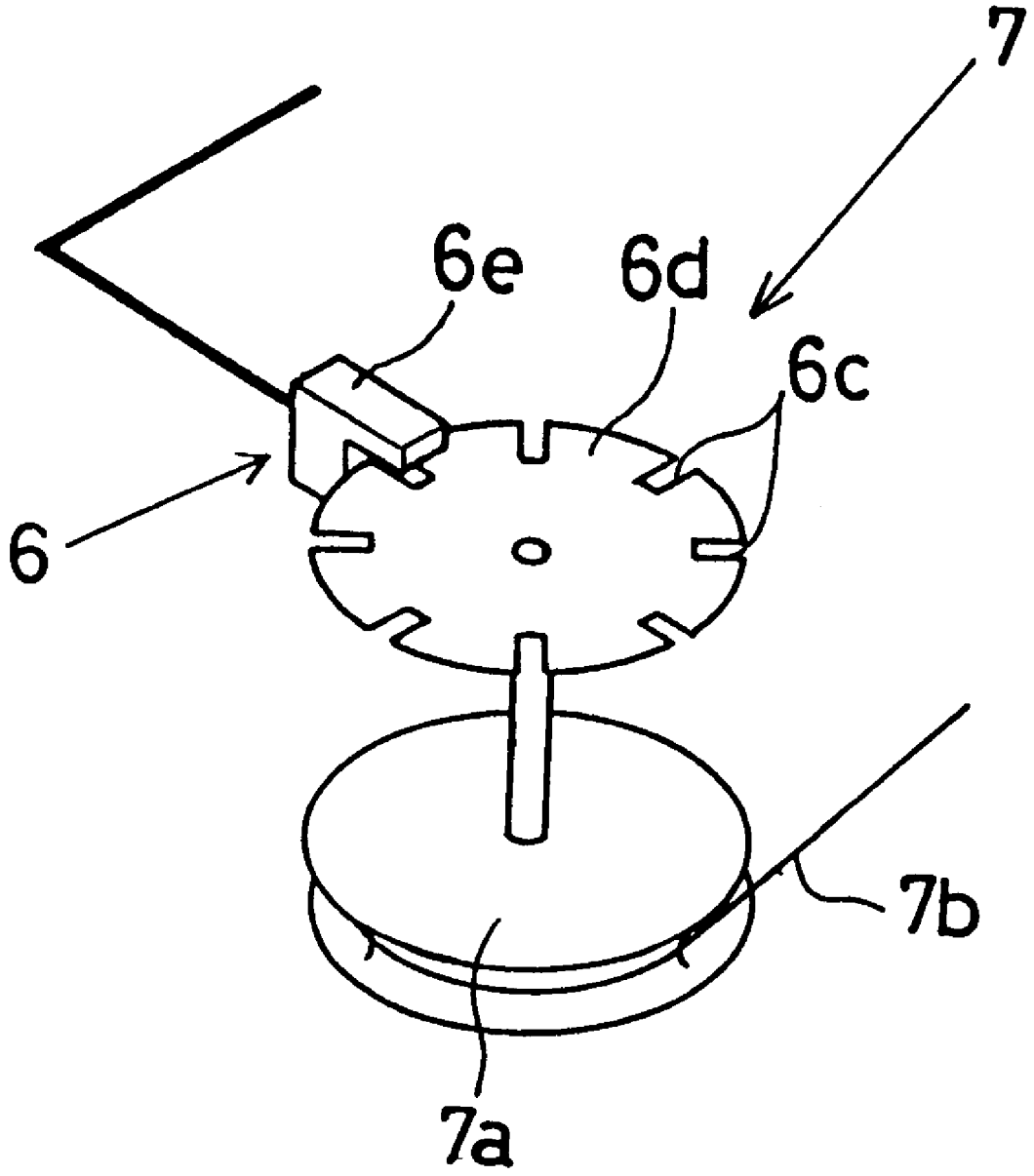
FIG. 8 is a perspective view of an under thread detection member according to a modified form of the first embodiment of the invention.

As an alternative, instead of the under thread detection member 4*d* in which the stitching number signal (F) is used to detect the amount of the under thread used during a continuous sewing operation, the under thread detection member may have a pulley 7*a* around which an upper thread 7*b* is extended to move with the start of the sewing operation. A detection sensor is provided to detect the revolution of the pulley 7*a* so as to calculate the amount of the upper thread 7*b* used during the sewing operation. In this instance, a notched disc 6*d*, similar to that in the stroke displacement detection member 6, is rotationally driven by the pulley 7*a* as shown in FIG. 8, and the passage number of the slits 6*c* is detected by the photosensor 6*e*.

It should be appreciated that instead of the pneumatic pressure, a manual power, an electric motor or an electromagnetic solenoid may be used to impart the urging force to the wire member 5.

It should be noted that instead of automatically activating the under thread detection device 1 at the time the sewing machine stops and the sewing needle reaches the top dead center, a starting switch may be provided to activate the under thread detection device 1 to advance the probe arm 3 toward the bobbin 2.

It should also be noted that instead of detecting the stroke displacement indirectly from the movable portion of the urging member, the stroke displacement may be directly detected from the wire member 5.

While the invention has been described with reference to the specific embodiments, it is understood that this description is not to be construed in a limiting sense in as much as various modifications and additions to the specific embodiments may be made by skilled artisans without departing from the scope of the invention.

We claim:

1. An under thread detection device for a sewing machine comprising:

a probe arm located outside a rotary bobbin case, and adapted to be accessible to a bobbin through a space provided at the rotary bobbin case when the rotary bobbin case ceases its rotary movement;

an urging member which provides an urging force in such a direction as to urge the probe arm toward a stem of the bobbin;

a wire member which transmits the urging force of the urging member to the probe arm;

a stroke detection member which measures a stroke displacement of the wire member;

a detection control member which calculates a residual amount of an under thread wound on the bobbin on the basis of the stroke displacement measured by the stroke detection member; and a display member which exhibits the residual amount of the under thread wound on the bobbin on the basis of the calculation performed by the detection control member.

2. An under thread detection device for a sewing machine as recited in claim 1, wherein the detection control member calculates the residual amount of the under thread wound on the bobbin on the basis of the stroke detection member by actuating the urging member when receiving a signal from a sewing control member that a sewing operation ends and a sewing needle reaches a top dead center.

3. An under thread detection device for a sewing machine as recited in claim 1 or 2, wherein the stroke detection member measures a stroke displacement of a movable portion of the urging member which urges the probe arm toward the bobbin by way of the wire member.

4. An under thread detection device for a sewing machine as recited in claim 3, wherein the stroke detection member comprising:

a rack member which slides in unison with the movable portion of the urging member;

a pinion which rotates in combination with the movement of the rack member;

a notched disc connected to an axis of the pinion to rotate therewith, the notched disc having a plurality of radial slits at regular intervals, and being diametrically greater than the pinion; and a photosensor which detects a passage of the slit provided on the notched disc with the rotary movement of the pinion.

5. An under thread detection device for a sewing machine as recited in claim 1 or 2 wherein the wire member is a helical coil spring which is coiled with no space between the neighboring coil segments.

6. An under thread detection device for a sewing machine comprising:

a probe arm located outside a rotary bobbin case, and adapted to be accessible to a bobbin through a space provided at the rotary bobbin case when the rotary bobbin case ceases its rotary movement;

an urging member which provides an urging force in such a direction as to urge the probe arm toward a stem of the bobbin;

a stroke detection member which measures a stroke displacement of the probe arm;

an under thread detection member which detects an amount of an under thread used in association with a continuous operation of a sewing machine;

a detection control member which calculates a residual amount of the under thread wound on the bobbin on the basis of the stroke displacement measured by the stroke detection member, and subtracts the used amount of the under thread detected by the under thread detection member from the residual amount of the under thread so as to calculate the present residual amount of the under thread; and a display member which exhibits the residual amount of the under thread wound on the bobbin on the basis of the calculation performed by the detection control member.

7. An under thread detection device for a sewing machine as recited in claim 6, wherein the under thread detection member receives a stitching number signal which is indicative of stitching action of a sewing needle, and generated from a sewing control member of the sewing machine; and the detection control member subtracts the used amount of the under thread in accordance with the stitching number signal.

8. An under thread detection device for a sewing machine as recited in claim 6, wherein the under thread detection member comprises a pulley rotationally driven by an upper thread moved in combination with the sewing operation of the sewing machine, and a detection sensor which detects revolutions of the pulley; and wherein the detection control member calculates the used amount of the under thread based on the revolutions of the pulley detected by the detection sensor.

9. An under thread detection device for a sewing machine as recited in claim 6, wherein the urging member is placed remote from the probe arm, and the urging force is given to the probe arm by way of a wire member.

10. An under thread detection device for a sewing machine as recited in claim 6, wherein the detection control member calculates the residual amount of the under thread wound on the bobbin on the basis of the stroke detection member by actuating the urging member when receiving a signal from the sewing control member that a sewing operation ends and a sewing needle reaches a top dead center.

11. An under thread detection device for a sewing machine as claimed in claim 3, wherein the wire member is a helical coil spring which is coiled with no space between the neighboring coil segments.

12. An under thread detection device as claimed in claim 1, wherein said urging member includes a piston and a fluid supply in communication with said piston.

13. An under thread detection device as claimed in claim 6, wherein said urging member includes a piston and a fluid supply in communication with said piston.

* * * * *